United States Patent [19]

Masui et al.

[11] 4,316,376

[45] Feb. 23, 1982

[54] METHOD FOR PREVENTING WANDERING OF STRIP UNDER ROLLER LEVELING IN HOT ROLLING LINE

[75] Inventors: Takeshi Masui, Nishinomiya; Yoshiro Masui, Ashiya; Teruo Hiramatu; Tomisabro Yamada, both of Ibaraki, all of Japan

[73] Assignee: Sumitomo Metal Industries, Ltd., Osaka, Japan

[21] Appl. No.: 149,953

[22] Filed: May 15, 1980

[51] Int. Cl.[3] ..... B21B 1/26; B21B 41/00

[52] U.S. Cl. ..... 72/161; 72/164; 72/250; 72/366

[58] Field of Search ..... 72/161, 164, 231, 234, 72/250, 12, 366

[56] References Cited

U.S. PATENT DOCUMENTS

| | | | |
|---|---|---|---|
| 2,095,733 | 10/1937 | Corgell | 72/205 X |
| 3,225,577 | 12/1965 | Sloan | 72/12 |
| 3,453,847 | 7/1969 | Romanuaskas | 72/205 X |
| 3,839,888 | 10/1974 | Greenberger | 72/161 X |
| 4,171,632 | 10/1979 | Noe | 72/161 X |

FOREIGN PATENT DOCUMENTS

| | | | |
|---|---|---|---|
| 54-133461 | 10/1979 | Japan | 72/161 |
| 451484 | 2/1974 | U.S.S.R. | 72/161 |

*Primary Examiner*—Milton S. Mehr

*Attorney, Agent, or Firm*—Wenderoth, Lind & Ponack

[57] ABSTRACT

Wandering of a strip in a hot rolling line is prevented by the provision of a hot roller leveler and a side guide between a finishing mill and a coiler. At least one of the leveler rolls is made angularly adjustable in a horizontal plane and/or in a vertical plane with respect to the strip.

10 Claims, 19 Drawing Figures

METHOD FOR PREVENTING WANDERING OF STRIP UNDER ROLLER LEVELING IN HOT ROLLING LINE

BACKGROUND OF THE INVENTION

The present invention relates to a method for preventing wandering of a strip in a hot rolling line and, more particularly, to a method for correcting a hot rolled strip in which shape defects of the hot rolled strip are corrected in the hot rolling line and the wandering of the strip during the correction is prevented.

Demands for increased flatness of hot rolled strip have recently become more and more severe, and now, if sufficient flatness is provided, hot rolled strips can be used in place of more expensive cold rolled strips.

In the manufacture of steel strips by a continuous hot rolling mill, the relatively large distance between the final mill stand of the finishing mill and the coiler presents a problem in that the strip bottom, having passed the final finishing stand, becomes under zero tension and flutters. The fluttering of the strip bottom is a cause for such shape defects as out of flatness, edge defect, and edge break and defective appearance of the coil.

For this reason, hot rolled strips have been, after rolling in the continuous hot rolling mill, temper-rolled and simultaneously corrected in flatness. If the hot strip produced by such mill had satisfactory flatness it would be possible to eliminate the temper rolling step. Heretofore, however, it has been necessary to conduct the temper rolling operation to obtain the required flatness of the hot rolled strips.

As mentioned above, the insufficient flatness of the hot rolled steel strips causes defective appearance of the coil which presents noticeable problems in the succeeding production steps such as, for example in the case of mother material for cold rolling, decrease in pickling efficiency resulting from decrease in passability of plates in the pickling line and wandering of the strip.

To overcome these problems, the inventors previously presented a method in which a hot roller leveler is provided between the final finishing mill and the coiler, so that the flatness of the hot rolled steel strip is corrected by the roll force of the hot roller leveler and the tension between the finishing mill and the coiler (Japanese Patent Publication No. 48182/78 which issued as Japanese Patent No. 968053).

It has been confirmed that such previous method mentioned above sharply reduced the shape defects of strips such as center buckles and edge waves. However, in the cases where the thickness distribution of the strip in the widthwise direction is not symmetrical, where the rolled shape is extremely asymmetrical, where the temperature distribution of the strip is asymmetrical (mainly due to unsatisfactory spray), and where the parallelism among the units of the rolling line is not complete (it is difficult to maintain complete parallelism among the units throughout the long rolling line), the leveling of the strip by the hot roller leveler sometimes caused the strip to wander sideways so violently that the strip edge hit the support members (side guides, etc.) to thereby cause edge defects and, in the extreme case, make the coiling operation impossible.

SUMMARY OF THE INVENTION

Accordingly, an object of the present invention is to prevent wandering of a strip under roller leveling in a hot rolling line, thereby stabilizing the flatness correction of the strip and improving the coil appearance of the strip.

In the method according to the present invention, in order to achieve the above object, at least one hot roller leveler comprising a plurality of leveler rolls is provided between the finishing rolling mill and the coiler of the hot rolling line to correct the flatness of the hot strip. The hot roller leveler is constructed as follows:

a. At least one leveler roll is supported to be angularly adjustable in a horizontal plane with respect to the strip.

b. At least one leveler roll is supported to be angularly adjustable in a vertical plane with respect to the strip.

c. At least one leveler roll is supported to be angularly adjustable in a horizontal plane and in a vertical plane, respectively, with respect to the strip.

d. At least one leveler roll is supported to be angularly adjustable in a horizontal plane with respect to the strip and at least one other leveler roll is supported to be angularly adjustable in a vertical plane with respect to the strip.

Further, a side guide is provided on an entrance side, or on an exit side, or on both sides of one or more hot roller levelers constructed as described above, to prevent wandering of the strip.

BRIEF DESCRIPTION OF THE DRAWINGS

The invention will be better understood from the following description taken in connection with the accompanying drawings in which.

DESCRIPTION OF THE PREFERRED EMBODIMENTS

Figure 1:
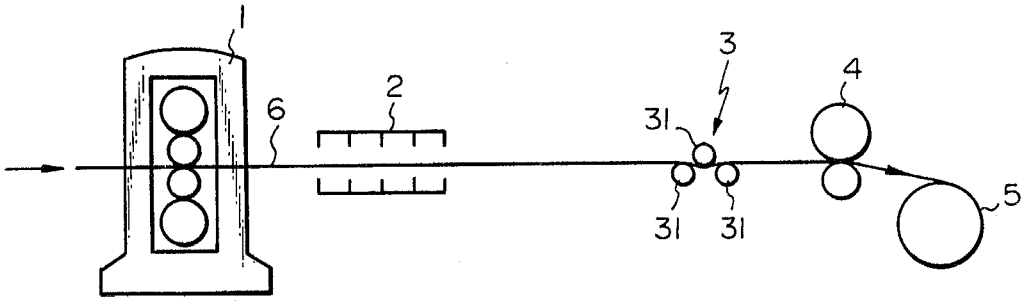
FIGS. 1 and 2 are illustrations of a finishing mill and subsequent elements of a hot rolling line in which the method according to the present invention is applied.
Figure 2:
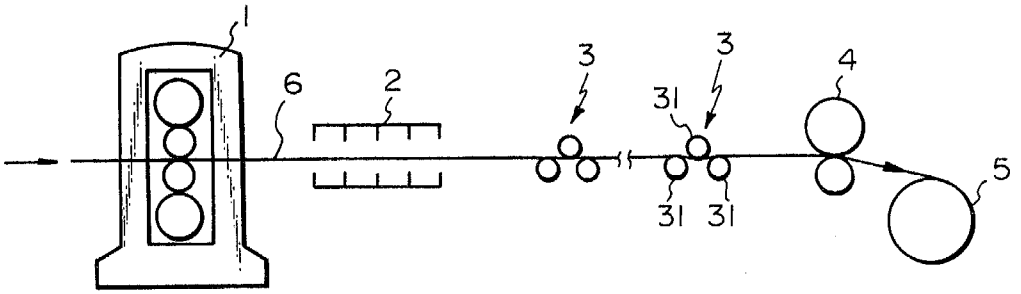

With reference now to the drawings and more particularly to FIGS. 1 and 2 thereof, there are schematically illustrated examples of a final mill stand and subsequent elements of a hot rolling line. In the method according to the present invention, as shown, one or more hot roller levelers 3 are provided between a final mill stand 1 of a finishing mill and a coiler 5 in the hot rolling line. A strip 6 having emerged from the final stand 1 of the finishing mill passes a cooling water spray zone 2, is leveled by the hot roller leveler 3, passes through pinch rolls 4, and is coiled by the coiler 5. In this hot rolling line, the hot roller leveler 3 is provided in the neighborhood of the coiler 5 and preferably immediately before the pinch rolls 4.

The hot roller leveler 3 comprising a plurality of (three in the illustrated examples) leveler rolls 31 is provided in a single unit (FIG. 1) or in a plurality of units (FIG. 2).

Figure 3:
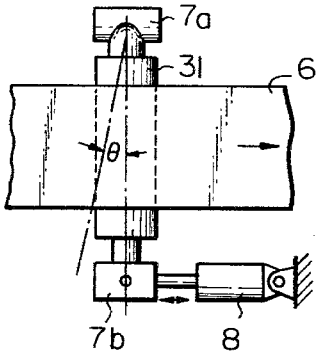
FIG. 3 is a plan view of a leveler roll arranged to be angularly adjustable in a horizontal plane with respect to the strip.
Figure 4:
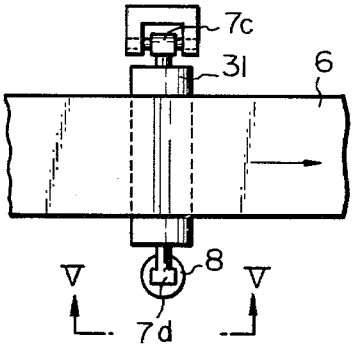
FIG. 4 is a plan view of a leveler roll arranged to be angularly adjustable in a vertical plane with respect to the strip.
Figure 6:
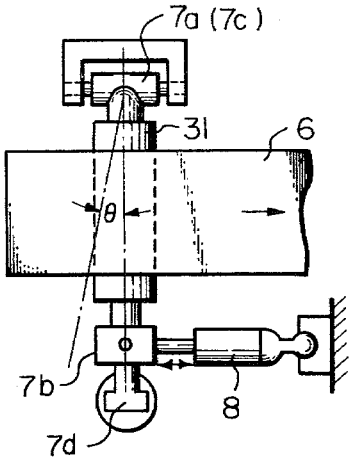
FIG. 6 is a plan view of a leveler roll arranged to be angularly adjustable in a horizontal plane and in a vertical plane with respect to the strip.

In the method according to the present invention, the hot roller leveler 3 is constructed as follows:

a. At least one leveler roll 31 is supported to be angularly adjustable in a horizontal plane with respect to the strip 6 (FIG. 3).

b. At least one leveler roll 31 is supported to be angularly adjustable in a vertical plane with respect to the strip 6 (FIG. 4).

c. At least one leveler roll 31 is supported to be angularly adjustable in a horizontal plane and in a vertical plane, respectively, with respect to the strip 6 (FIG. 6).

d. At least one leveler roll 31 is supported to be angularly adjustable in a horizontal plane with respect to the strip 6 and at least one other leveler roll 31 is supported to be angularly adjustable in a vertical plane with respect to the strip 6 (FIG. 6).

Adjustment of the angle of the leveler roll 31 in the horizontal plane is accomplished by, for example, the construction shown in FIG. 3, in which one bearing *7a* of the leveler roll 31 is a pivot bearing and the other bearing *7b* thereof is so constructed as to be slidably movable in the horizontal direction and is connected to a hydraulic cylinder 8 maintained horizontal.

Figure 5:
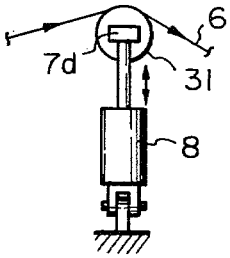
FIG. 5 is a side view taken from the line V—V of FIG. 4.

The adjustment of the angle of the leveler roll 31 in the vertical plane is accomplished by, for example, the construction shown in FIGS. 4 and 5, in which one bearing *7c* of the leveler roll 31 is so supported as to be pivotally movable in a vertical plane and the other bearing *7d* is connected to a hydraulic cylinder 8 maintained vertical.

The adjustment of the angle of the leveler roll 31 in the horizontal plane and in the vertical plane, respectively, is accomplished by, for example, the construction shown in FIG. 6, in which the bearings *7a* and *7b* shown in FIG. 3 are combined with the bearings *7c* and *7d* shown in FIG. 4 respectively.

The construction shown in FIG. 1, in which one unit of the roller leveler 3 comprising the three leveler rolls 31 is provided between the finishing mill 1 and the coiler 5, will now be described in detail for the purpose of confirming the effects of each of the rolls. From an idealistic viewpoint, however, use of a hot roller leveler having more rolls is preferably since the greater the number of the rolls, the higher are the effects obtained thereby in flatness correction and descaling of the strip. The roller leveler may be of a four-high type having back-up rolls for supporting deflection of the work rolls or may be of a two-high type having only the work rolls.

In the hot roller leveler 3 shown in FIG. 1, the wandering of the strip 6 traveling on the line can be corrected by adjusting the angle of the leveler roll 31 positioned on the upper side of the strip in combination with one or two of the two leveler rolls 31, 31 positioned on the under side of the strip.

Figure 7:
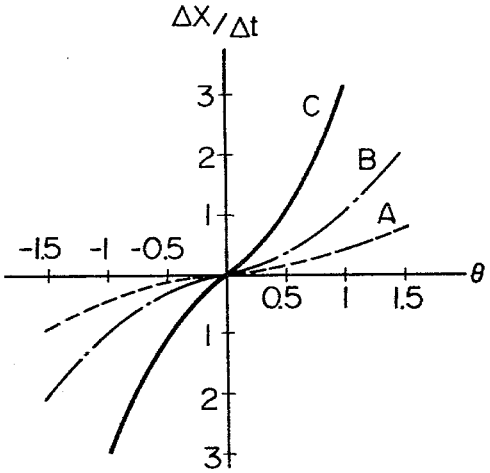
FIG. 7 is a graph showing the wandering correcting effect by the method according to the present invention.

FIG. 7 shows the results of tests on the relation between an angle of inclination $\theta$ in a horizontal plane of the leveler roll 31 and an amount of wandering $\Delta x$ of the strip 6. In FIG. 7, the horizontal axis denotes the angle of inclination $\theta$ of the roll and the vertical axis denotes the amount of wandering per unit time $\Delta x/\Delta t$.

The strip used in this test was a common hot-rolled steel strip of thickness of 1.6–3.2 mm and width of 900–1300 mm. In FIG. 7, A indicates the case in which only the leveler roll 31 positioned at the left on the under side of the strip 6 was adjusted in angle, B indicates the case in which only the leveler roll 31 positioned on the upper side of the strip 6 was adjusted in angle, and C denotes the case in which all the three leveler rolls 31, 31, 31 were adjusted in angle.

FIG. 7 shows that in any of the cases, the greater the angle of inclination $\theta$ of the roll is, the greater becomes the amount of wandering $\Delta x$ of the strip 6 and that when the angle of inclination $\theta$ of the roll varies in the reverse direction, the amount of wandering $\Delta x$ of the strip also varies in the reverse direction. FIG. 7 shows further that the effect by adjustment of the angle of the leveler roll is greater in the intermediate roll than in the roll on the entrance or exit side and that the greatest effect is achieved by adjusting the angles of all the rolls.

Accordingly, in the method according to the present invention, the wandering of the strip can be canceled and prevented by adjusting the angle of at least one of the three leveler rolls 31 with the strip 6 in the horizontal plane.

Figure 8:
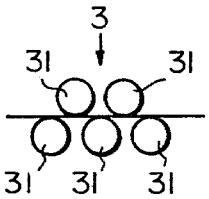
FIG. 8 is a schematic side view of another embodiment of the hot roller leveler used in the method according to the present invention.
Figure 9:
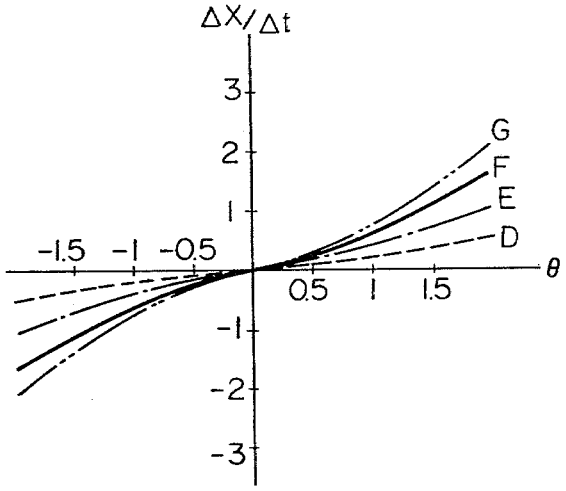
FIG. 9 is a graph similar to that of FIG. 7, showing other wandering correcting effect.

FIG. 9 shows the results of tests on the relation between the angle of inclination $\theta$ of the roll and the amount of wandering $\Delta x$ of the strip 6 in the hot roller leveler having five leveler rolls 31 as shown in FIG. 8. In FIG. 9, the vertical and the horizontal axes denote the same items as in FIG. 7. In FIG. 9, D denotes the case in which one leveler roll 31 positioned at the left on the under side of the strip 6 is inclined in the vertical plane, E denotes the case in which one leveler roll 31 positioned at the left on the upper side of the strip 6 is inclined in the vertical plane, F denotes the case in which both said leveler rolls 31, 31 are inclined simultaneously in the vertical plane; and G denotes the case in which one leveler roll 31 positioned at the left on the upper side of the strip 6 is inclined in the vertical plane and one leveler roll 31 positioned at the right on the under side of the strip 6 is simultaneously inclined in the horizontal plane.

The strip used in this test was a common hot-rolled steel strip of thickness of 1.2–3.2 mm and width of 900–1300 mm.

FIG. 9 shows that in any of the cases, the greater the angle of inclination $\theta$ of the roll is, the greater becomes the amount of wandering $\Delta x$ of the strip and that when the angle of inclination $\theta$ of the roll varies in the reverse direction, the amount of wandering $\Delta x$ of the strip also varies in the reverse direction. FIG. 9 shows further that the effect by adjustment of the angle of the leveler roll is greater in the intermediate roll than in the roll on the entrance or exit side and that the effect is enhanced by combining the adjustment of the angle of inclination of the roll in the vertical plane with the adjustment of the angle of inclination of the roll in the horizontal plane.

One reason for combining the adjustment of the angle of inclination of the roll in the vertical plane with that in the horizontal plane is that when the roll to be adjusted in the vertical plane is inclined at a large angle in the vertical plane the intermesh of the leveler roll varies from one edge of the strip to the other, and if the angle of inclination of the roll in the vertical plane is made large when the amount of wandering of the strip is large the shape of the strip at one edge will be changed into, for example, an edge wave to cause shape defects. For this reason, the angle of inclination of the roll in the vertical plane is preferably made small and the adjustment thereof is preferably combined with the adjustment of the angle of inclination of the roll in the horizontal plane.

Practically, it is simplest and most effective to incline the entire leveler unit in the horizontal and/or the vertical planes.

In the method according to the present invention described hereinabove, by adjusting the angle of inclination of the leveler roll so as to cancel the wandering of the steel strip during hot rolling thereof, it is made possible to move the strip centrally of the line to thereby prevent the edges of the strip from abutting against the guides which would cause edge defects and to thereby enable the strip to be leveled stably.

While the foregoing description is made with reference to the example in which the hydraulic cylinder 8 is used as the means for inclining the leveler rolls 31, it will be obvious to those skilled in the art that the hydraulic cylinder 8 may be replaced by any other suitable inclining means such, for example, as a rack and pinion mechanism and a link and lever mechanism.

Figure 10:
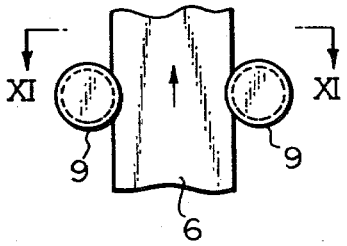
FIG. 10 is a plan view of a roller type side guide adjustable in position, used in the method according to the present invention.
Figure 11:
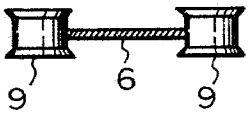
FIG. 11 is a front view taken from the line XI—XI of FIG. 10.
Figure 12:
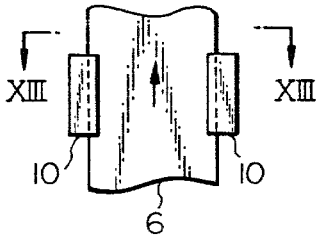
FIG. 12 is a plan view of a plate type side guide adjustable in position, used in the method according to the present invention.
Figure 13:
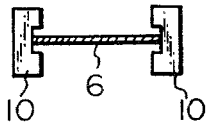
FIG. 13 is a front view taken from the line XIII—XIII of FIG. 12.

For safer and securer prevention of wandering of the steel strip, it is preferable to use a position-adjustable roller type side guide 9 as shown in FIGS. 10 and 11 or a position-adjustable plate type side guide 10 as shown in FIGS. 12 and 13.

Figure 14:
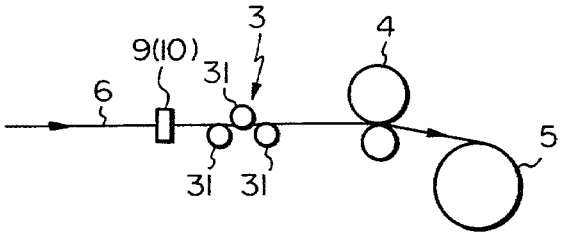
FIGS. 14 to 16 are illustrations of examples of arrangements in which a roller leveler is provided with one or more side guides.
Figure 15:
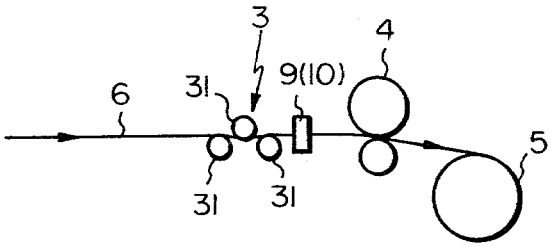
Figure 16:
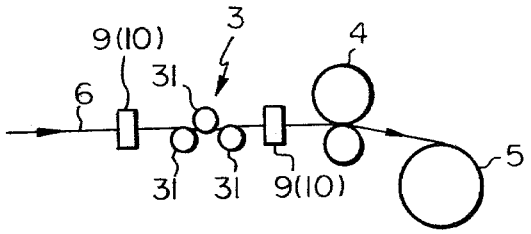

In the construction including only one unit of the hot roller leveler 3, the side guide 9 or 10 is provided either on the entrance side of the leveler 3 (FIG. 14) or on the exit side thereof (FIG. 15) or on each of the entrance and exit sides thereof (FIG. 16).

Figure 17:
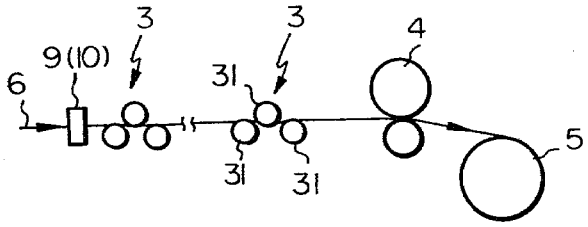
FIGS. 17 to 19 are illustrations of examples of arrangements in which a plurality of roller levelers are provided with one or more side guides.
Figure 18:
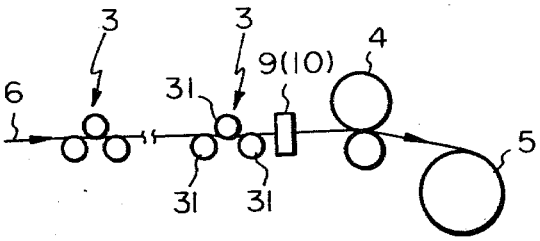
Figure 19:
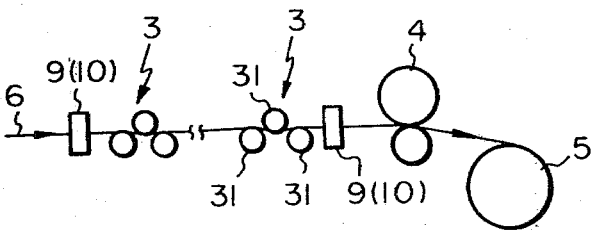

In the construction including a plurality of the roller levelers 3, the side guide 9 or 10 is provided only on the entrance or on the exit side of each leveler or on each of said sides thereof as necessary. Alternatively, the side guide 9 or 10 may be effectively provided in the manner as shown in any of FIGS. 17 to 19.

In the method according to the present invention, as described hereinabove, severe wandering of the steel strip is forcibly restrained by adjusting the angle of inclination of the leveler roll 31 and shifting the strip quickly to the central zone of the line while holding the edges of the strip 6 with the side guide 9 or 10. Accordingly, it is made possible to render stable leveling of the hot rolled steel strip and to sharply increase the grade of the strip flatness in the hot rolling line.

By increasing the intermesh of the leveler rolls and effectively utilizing the leveler as back tension means for coiling after the coil end passes through the final mill stand, it is made possible to obtain effects such as prevention of edge break and other edge defects resulted from a zero tension state after the passing of the coil end through the final mill stand and as grade up of the coiling form.

The leveling operation according to the present invention can be easily automated by providing a sensor of the amount of wandering of the strip and connecting the output of the sensor to the means for adjusting the angle of the leveler roll.

Further, the method according to the present invention provides additional advantages such as increase in descaling effect leading to increase in efficiency of the pickling line because the scale on the surface of the hot rolled strip is easily cracked by repeated bending under tension width leveler rolls.

While there has been described and illustrated a present preferred method of practicing the invention, it is to be distinctly understood that the invention is not limited thereto but may be otherwise variously practiced within the scope of the following claims.

What is claimed is:

1. In a method for the formation of strip in a hot rolling line, wherein the strip is passed through mill stands of the hot rolling line and is then coiled on a coiler, the improvement comprising:

providing between the last downstream said mill stand and said coiler at least one hot roller leveler unit comprising a plurality of leveler rolls, and passing said strip through said leveler rolls, thereby correcting shape defects in said strip; and preventing lateral wandering of said strip during passage thereof through said hot roller leveler unit by adjusting the angular orientation of at least one of said leveler rolls in a horizontal plane or in a vertical plane with respect to said strip.

2. The improvement claimed in claim 1, wherein said preventing comprises adjusting the angular orientation of at least one said leveler roll in both the horizontal plane and in the vertical plane with respect to said strip.

3. The improvement claimed in claim 1, wherein said preventing comprises adjusting the angular orientation of at least one said leveler roll in the horizontal plane with respect to said strip, and adjusting the angular orientation of at least one other said leveler roll in the vertical plane with respect to said strip.

4. The improvement claimed in claims 1, 2 or 3, wherein said preventing further comprises providing strip side guides at the entrance end of said at least one hot roller leveler unit for guiding lateral edges of said strip.

5. The improvement claimed in claims 1, 2 or 3, wherein said preventing further comprises providing strip side guides at the exit end of said at least one hot roller leveler unit for guiding lateral edges of said strip.

6. The improvement claimed in claims 1, 2 or 3, wherein said preventing further comprises providing strip side guides at the entrance and exit ends of said at least one hot roller leveler unit for guiding lateral edges of said strip.

7. The improvement claimed in claim 1, comprising providing plural said hot roller level units between said last downstream mill stand and said coiler, successively passing said strip through said plural hot roller leveler units, and adjusting the angular orientation of at least one of said leveler rolls of each of said hot roller leveler units.

8. The improvement claimed in claim 7, wherein said preventing further comprises providing strip side guides at the entrance end of the upstream most of said plural hot roller leveler units for guiding lateral edges of said strip.

9. The improvement claimed in claim 7, wherein said preventing further comprises providing strip side guides at the exit end of the downstream most of said plural hot roller leveler units for guiding lateral edges of said strip.

10. The improvement claimed in claim 7, wherein said preventing further comprises providing strip side guides at the entrance end of the upstream most and at the exit end of the downstream most of said plural hot roller leveler units for guiding lateral edges of said strip.

* * * * *